US011053743B2

(12) United States Patent
Luo et al.

(10) Patent No.: US 11,053,743 B2
(45) Date of Patent: Jul. 6, 2021

(54) POLYCRYSTALLINE DIAMOND COMPACT DRILL BIT AND OIL WELL DRILLING APPARATUS HAVING THE SAME

(71) Applicant: SEED TECHNOLOGIES CORP., LTD., HuNan (CN)

(72) Inventors: Jianghe Luo, HuNan (CN); Runan Zhang, HuNan (CN); Weixiong Wang, HuNan (CN); Lei Wen, HuNan (CN)

(73) Assignee: SEED TECHNOLOGIES CORP., LTD., Zhuzhou (CN)

( * ) Notice: Subject to any disclaimer, the term of this patent is extended or adjusted under 35 U.S.C. 154(b) by 49 days.

(21) Appl. No.: 16/584,831

(22) Filed: Sep. 26, 2019

(65) Prior Publication Data

US 2021/0017815 A1 Jan. 21, 2021

(30) Foreign Application Priority Data

Jul. 19, 2019 (CN) ..... 201910654997.5
Jul. 19, 2019 (CN) ..... 201921150404.3

(51) Int. Cl.
*E21B 10/62* (2006.01)
*E21B 10/567* (2006.01)
*E21B 10/42* (2006.01)

(52) U.S. Cl.
CPC ..... *E21B 10/62* (2013.01); *E21B 10/42* (2013.01); *E21B 10/567* (2013.01)

(58) Field of Classification Search
CPC ..... E21B 10/62; E21B 10/42; E21B 10/567
See application file for complete search history.

(56) References Cited

U.S. PATENT DOCUMENTS 3,554,306 A * 1/1971 Wilburn ..... E21B 17/046 175/320
4,632,195 A * 12/1986 Emmerich ..... E21B 17/046 175/320
6,092,612 A * 7/2000 Brady ..... E21B 10/60 175/325.2
2012/0125691 A1* 5/2012 Strydom ..... E21B 10/36 175/108
2018/0058148 A1* 3/2018 Zhang ..... E21B 10/55

* cited by examiner

*Primary Examiner* — Brad Harcourt
(74) *Attorney, Agent, or Firm* — Yue (Robert) Xu; Apex Attorneys at Law, LLP

(57) ABSTRACT

A polycrystalline diamond compact drill bit includes a steel body connector and a matrix crown. The matrix crown is provided with multiple main blades extending axially. A rear end surface of the matrix crown is provided with a connecting block projecting backwardly. A front end surface of the steel body connector is provided with a connecting groove having a shape matching a shape of the connecting block. The connecting block is inserted into the connecting groove to form an interference fit with the connecting groove. The rear end surface and the front end surface are fitted to each other. The periphery of the connecting block is provided with an inner positioning hole. A periphery of the steel body connector is provided with an outer positioning hole penetrating into the connecting groove at a position corresponding to the inner positioning hole.

12 Claims, 2 Drawing Sheets

POLYCRYSTALLINE DIAMOND COMPACT DRILL BIT AND OIL WELL DRILLING APPARATUS HAVING THE SAME

This application claims the benefit of priority to Chinese Patent Applications No. 201910654997.5 and No. 201921150404.3 both titled "POLYCRYSTALLINE DIAMOND COMPACT DRILL BIT AND OIL WELL DRILLING APPARATUS HAVING THE SAME", and filed with the China National Intellectual Property Administration on Jul. 19, 2019, the entire disclosures thereof are incorporated herein by reference.

FIELD

The present application relates to the field of oil equipment, and in particular to a polycrystalline diamond compact drill bit. The present application also relates to an oil well drilling apparatus having the drill bit.

BACKGROUND

The polycrystalline diamond compact drill bit (PDC drill bit) uses the polycrystalline diamond compact with extremely high hardness as cutting teeth of the drill bit, which has high rock-breaking efficiency and a high drilling rate, and is the most widely used drill tool in the oil well drilling field at present. The PDC drill bit includes a steel body connector and a matrix crown. The matrix crown is made by sintering tungsten carbide alloy powder, and then the matrix crown is welded to the steel body connector to form the whole drill bit.

Since the steel body connector and the matrix crown are provided separately, the problems of connection and sealing are required to be addressed. In the conventional technology, the steel body connector and the matrix crown are generally threadedly connected to each other, and the gap at the junction is welded, to ensure the secure sealing connection between the steel body connector and the matrix crown. However, the threaded connection has an obvious defect, when the drill bit and the screw drill are working underground, the rotation thereof is in a circumferential direction, and the steel body connector and the matrix crown are connected through threaded connection in the circumferential direction, which easily causes the problem that the matrix crown may loosen or even fall down the well due to a small twisting force in a harsh environment of high pressure and great impact. There is a welding layer between the steel body connector and the matrix crown, however, since the welding layer is formed by only welding the surface of the gap superficially, the real metallurgical bonding is not realized. Moreover, the underground working condition is extremely harsh and the wear is severe, the connection effect is weaker after the welding layer is worn off.

Besides, the hardness of the tungsten carbide alloy is extremely high, and thus the thread processing is very difficult to perform. In a case that the matrix crown is manufactured by the 3D printing technology, although the shape of the threads can be printed, the 3D printing cannot directly print the threads that meet the precision requirements, and high precision threads can only be obtained through machining. However, due to the brittleness of the matrix material itself, the threads cannot withstand very great tension, which eventually causes the failure of the threads of the matrix crown.

Therefore, a technical problem to be addressed by those skilled in the art is to provide a polycrystalline diamond compact drill bit which can stably transmit torque and tension and has improved stability and mechanical properties.

SUMMARY

An object of the present application is to provide a polycrystalline diamond compact drill bit, which stably transmits torque and tension through a connecting block structure and positioning members, is easy to process, and has improved stability and mechanical properties. Another object of the present application is to provide an oil well drilling apparatus having the drill bit.

In order to address the above technical problem, a polycrystalline diamond compact drill bit is provided according to the present application, including a steel body connector and a matrix crown. The matrix crown is provided with multiple main blades extending axially. A rear end surface of the matrix crown is provided with a connecting block projecting backwardly. A periphery of the connecting block is provided with multiple outer wall planes around an axis. A front end surface of the steel body connector is provided with a connecting groove having a shape matching a shape of the connecting block. The connecting block is inserted into the connecting groove to form an interference fit with the connecting groove. The rear end surface and the front end surface are fitted to each other. The periphery of the connecting block is provided with an inner positioning hole. A periphery of the steel body connector is provided with an outer positioning hole penetrating into the connecting groove at a position corresponding to the inner positioning hole. The polycrystalline diamond compact drill bit further includes a positioning member penetrating the outer positioning hole and inserted into the inner positioning hole.

Preferably, multiple inner positioning holes are arranged in the multiple outer wall planes respectively, multiple outer positioning holes are in inner wall planes of the connecting groove respectively, and both the inner positioning holes and the outer positioning holes extend radially.

Preferably, a periphery of a front end of the steel body connector is provided with multiple extension blades corresponding to the multiple main blades respectively, and each of the main blades is connected to a corresponding one of the extension blades to form an integral body.

Preferably, the polycrystalline diamond compact drill bit includes six main blades and six extension blades arranged uniformly.

Preferably, the connecting block is specifically a regular hexagonal prism including six outer wall planes consecutively arranged, and the connecting groove is correspondingly provided with six inner wall planes.

Preferably, each of the outer wall planes is arranged corresponding to a gap between two adjacent main blades, the inner positioning hole is arranged in a middle portion of the outer wall plane, each of the inner wall planes is arranged corresponding to a gap between two adjacent extension blades, and the outer positioning hole is arranged in the gap between the two adjacent extension blades and penetrates to a middle portion of the inner wall plane.

Preferably, the matrix crown is integrally formed by 3D printing.

Preferably, a tail end of each positioning member is welded to an outer end port of the corresponding outer positioning hole.

Preferably, a molten metal sealing layer formed by electromagnetic induction heating is provided between the rear end surface and the front end surface.

An oil well drilling apparatus is further provided according to the present application, including the polycrystalline diamond compact drill bit according to any one of the above solutions.

The polycrystalline diamond compact drill bit including the steel body connector and the matrix crown is provided according to the present application. The matrix crown is provided with multiple main blades extending axially. The rear end surface of the matrix crown is provided with the connecting block projecting backwardly. The periphery of the connecting block is provided with multiple outer wall planes around the axis. The front end surface of the steel body connector is provided with the connecting groove having the shape matching the shape of the connecting block. The connecting block is inserted into the connecting groove to form an interference fit with the connecting groove. The rear end surface and the front end surface are fitted to each other. The periphery of the connecting block is provided with the inner positioning hole. The periphery of the steel body connector is provided with the outer positioning hole penetrating into the connecting groove at the position corresponding to the inner positioning hole. The polycrystalline diamond compact drill bit further includes the positioning member penetrating the outer positioning hole and inserted into the inner positioning hole.

The connecting block and the positioning holes are provided, and the positioning member is inserted to the positioning holes for fixation. With the above arrangement, the drill bit can withstand not only the tension in the axial direction but also the torque in the circumferential direction, which solves the connection problems in the two directions. In this way, no thread machining is required, the problem of threaded connection is overcome, and the reliability of the system is good. The matrix crown is wrapped by the steel body connector, thus the toughness of the steel body connector and the strength of the matrix crown are combined, and thereby improving the overall mechanical properties of the drill bit. The manufacture cost of the drill bit is saved, the drilling efficiency of the drilling team is improved, and the consumption of natural resources is effectively reduced, which has significant economic and social benefits.

An oil well drilling apparatus is further provided according to the present application, including the drill bit. Since the drill bit has the above technical effects, the oil well drilling apparatus also has the same technical effects, which will not be described in detail herein again.

DETAILED DESCRIPTION OF THE EMBODIMENTS

An object of the present application is to provide a polycrystalline diamond compact drill bit, which stably transmits torque and tension through a connecting block structure and positioning members, is easy to process, and has improved stability and mechanical properties. Another object of the present application is to provide an oil well drilling apparatus having the drill bit.

For those skilled in the art to better understand technical solutions of the present application, the present application will be further described in detail in conjunction with drawings and embodiments hereinafter.

Figure 1:
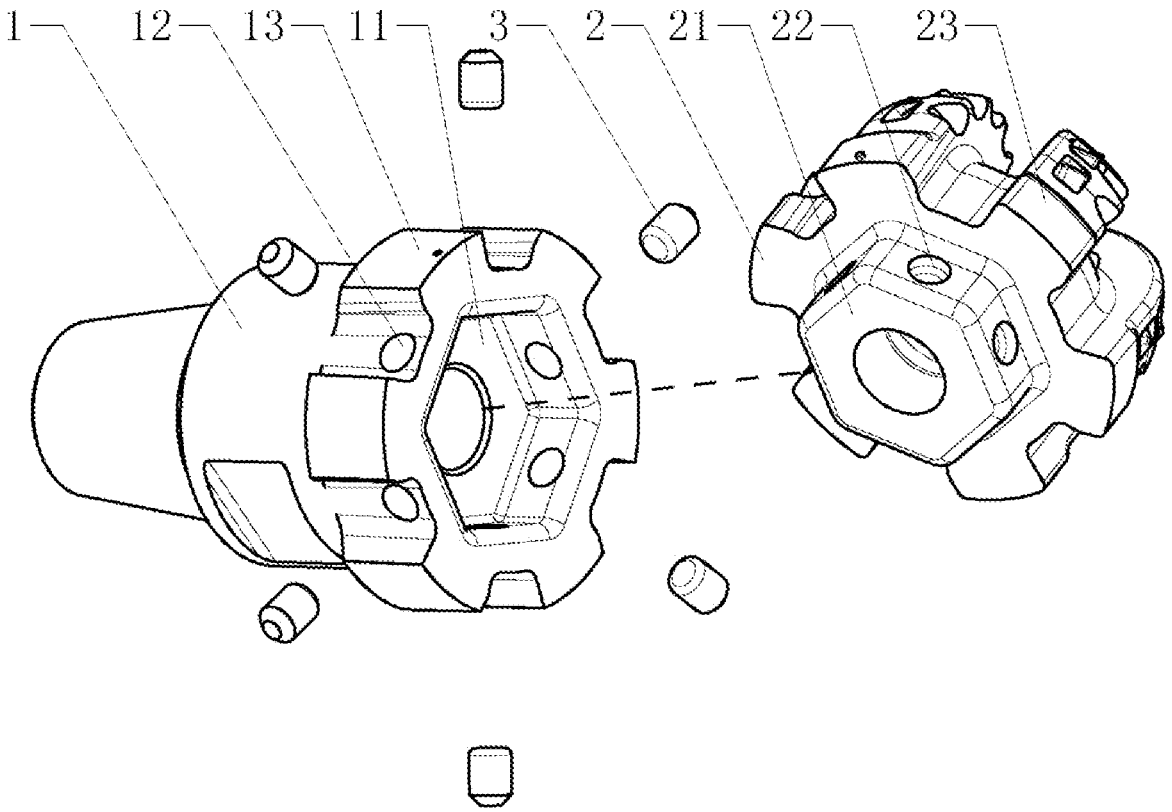
FIG. 1 is an exploded schematic view of a specific embodiment of a polycrystalline diamond compact drill bit according to the present application.
Figure 2:
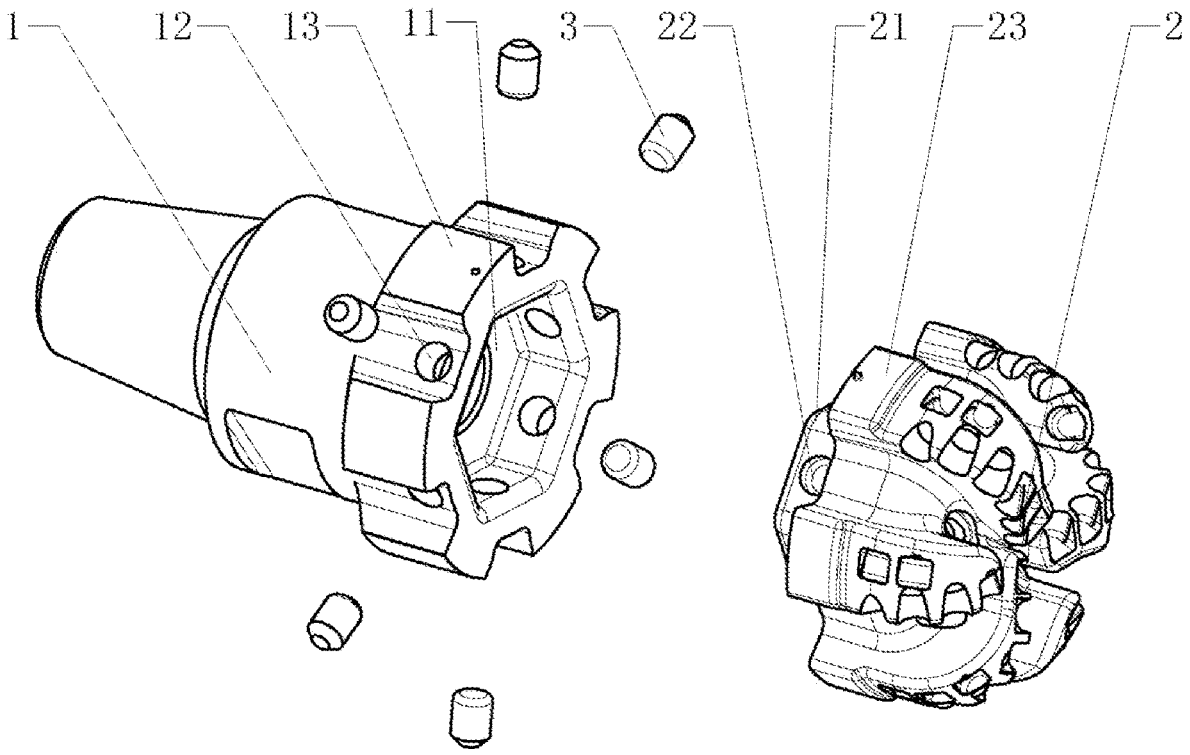
FIG. 2 is an exploded schematic view of the specific embodiment of the polycrystalline diamond compact drill bit according to the present application from another viewing angle.

Referring to FIGS. 1 and 2, FIG. 1 is an exploded schematic view of a specific embodiment of the polycrystalline diamond compact drill bit according to the present application; and FIG. 2 is an exploded schematic view of the specific embodiment of the polycrystalline diamond compact drill bit provided by the present application from another viewing angle.

A polycrystalline diamond compact drill bit is provided according to a specific embodiment of the present application, including a steel body connector 1 and a matrix crown 2. The matrix crown 2 is provided with multiple main blades 23 extending axially. One end of the steel body connector 1 connected to an oil well drilling apparatus is referred to as a rear end of the steel body connector, and another end connected to the matrix crown 2 is referred to as a front end of the steel body connector 1. One end of the matrix crown 2 connected to the steel body connector 1 is referred to as a rear end of the matrix crown 2, and another end thereof is referred to as a front end of the matrix crown 2. A rear end surface of the matrix crown 2 is provided with a connecting block 21 projecting backwardly. A periphery of the connecting block 21 is provided with multiple outer wall planes around an axis. A front end surface of the steel body connector 1 is provided with a connecting groove 11 having a shape matching a shape of the connecting block 21, that is, a periphery of the connecting groove 11 is provided with multiple inner wall planes around the axis, and the inner wall planes and the outer wall planes are in a one-to-one correspondence. The connecting block 21 is inserted into the connecting groove 11 to form an interference fit with the connecting groove 11, and the outer wall planes are in contact with and cooperate with the corresponding inner wall planes. Moreover, a height of the connecting block 21 and a depth of the connecting groove 11 match each other, so that the connecting block 21 can be inserted into the connecting groove 11, and the rear end surface of the matrix crown 2 and the front end surface of the steel body connector 1 are fitted to each other. The periphery of the connecting block 21 is provided with an inner positioning hole 22, the periphery of the steel body connector 1 is provided with an outer positioning hole 12 penetrating into the connecting groove 11 at a position corresponding to the inner positioning hole 22. The polycrystalline diamond compact drill bit further includes a positioning member 3. During installation, the positioning member 3 runs through the outer positioning hole 12 and is inserted into the inner positioning hole 22. The positioning member 3 may be a pin, or an inserting member of other types may be employed to realize axial positioning, so as to prevent separation.

The connecting block 21 is provided for connection, the positioning member 3 is inserted into the positioning holes to fixedly connect the two components, the drill bit can withstand tension in an axial direction through the positioning member 3, and can withstand torque in a circumferential direction through cooperation between the connecting block 21 and the connecting groove 11, which solves connection problems in two directions at the same time. In this way, no thread machining is required, problems of threaded connection are overcome, and reliability of a system is good. The matrix crown 2 is wrapped by the steel body connector 1, thus toughness of the steel body connector 1 and strength of the matrix crown 2 are combined, and thereby improving overall mechanical properties of the drill bit. A manufacture cost of the drill bit is saved, drilling efficiency of a drilling team is improved, and consumption of natural resources is effectively reduced, which has significant economic and social benefits.

Further, in order to improve stability of the connection, multiple inner positioning holes 22 are arranged in the multiple outer wall planes respectively, multiple outer positioning holes 12 are arranged in the inner wall planes of the connecting groove 11 respectively, and both the inner positioning holes 22 and the outer positioning holes 12 extend radially. Or, each of the positioning holes may be arranged at a junction of two corresponding adjacent planes; or, extending directions of the positioning holes may be adjusted, which are all within the protection scope of the present application.

In the polycrystalline diamond compact drill bit according to the specific embodiment of the present application, the periphery of the front end of the steel body connector 1 is provided with multiple extension blades 13 extending axially, and the multiple extension blades 13 correspond to the multiple main blades 23 respectively. A fracture of each of the main blades 23 is flush with the rear end surface of the matrix crown 2, and a fracture of each of the extension blades 13 is flush with the front end surface of the steel body connector 1, so that the corresponding main blade 23 and extension blade 13 are connected form a complete blade, which allows the entire drill bit to combine the toughness of the steel body connector 1 and the strength of the matrix crown 2, thereby obtaining excellent wear and impact resistance performance. Specifically, six main blades 23 and six extension blades 13 are arranged uniformly.

Further, the connecting block 21 is specifically a regular hexagonal prism. An axis of the regular hexagonal prism coincides with the axis of the drill bit, and the connecting block includes six outer wall planes consecutively arranged. Correspondingly, the connecting groove 11 is a regular hexagonal groove and includes six inner wall planes consecutively arranged. Of course, a transitional fillet may be provided between each two adjacent planes. In addition to the hexagon, other polygons such as an octagon, a decagon, a dodecagon or the like may also be employed, and other components may be adjusted accordingly.

In order to provide a good installation space, each of the outer wall planes is arranged corresponding to a gap between two adjacent main blades 23, the inner positioning hole 22 is arranged in a middle portion of the outer wall plane, each of the inner wall planes is arranged corresponding to a gap between two adjacent extension blades 13, and the outer positioning hole 12 is arranged in a the gap between the two adjacent extension blades and penetrates to a middle portion of the inner wall plane. Therefore, six positioning members 3 are provided to correspond to all the positioning holes, so as to complete connection. With the above arrangement, each of the positioning members 3 can be hidden in the gap between corresponding two adjacent extension blades 13, and thereby avoiding interference.

In the polycrystalline diamond compact drill according to the specific embodiment of the present application, the matrix crown 2 is integrally formed by 3D printing. By employing 3D printing, any structure can be formed, and polishing an end surface is much easier than machining threads. In addition, compared with manufacturing a crown of a drill bit having internal threads, a matrix material consumed by a method of manufacturing the crown of the drill bit by 3D printing is much less. In this way, not only the matrix material is saved and the manufacture cost is reduced, but also the high strength of the matrix crown 2 and the high toughness of the steel body connector 1 are obtained, which improves the overall impact resistance performance and the mechanical properties of the drill bit, prolongs a service life of the drill bit, and improves the drilling efficiency of the drilling team. A matrix crown formed by hot pressing or a split-type steel crown may also be employed, both of which can be connected through the above connection method.

Based on the polycrystalline diamond compact drill bit according to the above specific embodiments, a tail end of each of the positioning members 13 is welded to an outer end port of the corresponding one of the outer positioning holes 12, and a molten metal sealing layer is provided between the rear end surface and the front end surface. The molten metal sealing layer may be a brazing layer, that is, the layer is formed by melting a brazing rod and then cooling it.

The specific processing method is as follows. Printing the matrix crown 2 by 3D printing additive manufacturing technology, and appropriately polishing the hexagonal outer wall planes and the end surface of the connecting block 21 by plane grinding; the inner positioning holes 22 can be directly formed during 3D printing, and thus are not required to be processed separately.

A base body of the steel body connector 1 is obtained by machining, the extension blades 13 at the front end, and the inner hexagonal wall planes and the end surface of the connecting groove 11 are appropriately polished by grinding, and a size of the outer positioning hole 12 is the same as a size of the inner positioning hole 22.

The rear end surface of the matrix crown 2 is covered with welding rods, to prepare for subsequent brazing of the matrix crown 2 and the steel body connector 1.

A top of the steel body connector 1 is heated by induction heating. Since steel has a large thermal expansion coefficient, the heated steel body connector 1 is expanded to some extent, and the matrix crown 2 covered with the welding rods is pressed into the steel body connector 1, and pins are inserted, and then a tail end of each of the pins is welded to the outer end port of the corresponding outer positioning hole 12.

The connected steel body connector 1 and the matrix crown 2 are brazed to each other, the welding rods between the front end surface and the rear end surface are fully melted to form a brazing layer, and a tight seal connection between the matrix crown 2 and the steel body connector 1 is finally realized. Brazing can be carried out by means of electromagnetic induction heating, and the heating principle thereof is that through an electromagnetic induction effect of coils, a part of the steel body within magnetic induction lines of the coils is heated, and other parts of the steel body are not heated. A heating area and a heating time can be controlled conveniently. Compared with other brazing methods, the above method is more convenient in the field of drill bit brazing. The brazing may be carried out in a furnace, as long as the welding rods between the end surfaces can be fully melted and metallurgical bonding between the end surfaces can be realized. Of course, a mechanical sealing method such as sleeving a sealing ring may also be employed.

In addition to the polycrystalline diamond compact drill bit, an oil well drilling apparatus including the drill bit is further provided according to the present application. The structure of other parts of the oil well drilling apparatus can refer to the conventional technology, which is not described herein.

The polycrystalline diamond compact drill bit and the oil well drilling apparatus having the same according to the present application are described in detail hereinbefore. The principle and the embodiments of the present application are illustrated herein by specific examples. The above description of examples is only intended to help the understanding of the method and the spirit of the present application. It should be noted that, for those skilled in the art, a few of modifications and improvements may be made to the present application without departing from the principle of the present application, and these modifications and improvements are also deemed to fall into the scope of the present application defined by the claims.

The invention claimed is:

1. A polycrystalline diamond compact drill bit, comprising a steel body connector and a matrix crown, wherein the matrix crown is provided with a plurality of main blades extending axially, a rear end surface of the matrix crown is provided with a connecting block projecting backwardly, and a periphery of the connecting block is provided with a plurality of outer wall planes around an axis;

a front end surface of the steel body connector is provided with a connecting groove having a shape matching a shape of the connecting block, the connecting block is inserted into the connecting groove to form an interference fit with the connecting groove, the rear end surface and the front end surface are fitted to each other;

the periphery of the connecting block is provided with an inner positioning hole, a periphery of the steel body connector is provided with an outer positioning hole penetrating into the connecting groove at a position corresponding to the inner positioning hole; and the polycrystalline diamond compact drill bit further comprises a positioning member penetrating the outer positioning hole and inserted into the inner positioning hole; and wherein a molten metal sealing layer is provided between the rear end surface and the front end surface.

2. The polycrystalline diamond compact drill bit according to claim 1, wherein a plurality of inner positioning holes are arranged in the plurality of the outer wall planes respectively, a plurality of outer positioning holes are arranged in inner wall planes of the connecting groove respectively, and both the inner positioning holes and the outer positioning holes extend radially.

3. The polycrystalline diamond compact drill bit according to claim 2, wherein a periphery of a front end of the steel body connector is provided with a plurality of extension blades corresponding to the plurality of main blades respectively, and each of the main blades is connected to a corresponding one of the extension blades to form an integral body.

4. The polycrystalline diamond compact drill bit according to claim 3, wherein each of the outer wall planes is arranged corresponding to a gap between two adjacent main blades, the inner positioning hole is arranged in a middle portion of the outer wall plane, each of the inner wall planes is arranged corresponding to a gap between two adjacent extension blades, and the outer positioning hole is arranged in the gap between the two adjacent extension blades and penetrates to a middle portion of the inner wall plane.

5. An oil well drilling apparatus, comprising the polycrystalline diamond compact drill bit according to claim 2.

6. The polycrystalline diamond compact drill bit according to claim 1, wherein a periphery of a front end of the steel body connector is provided with a plurality of extension blades corresponding to the plurality of main blades respectively, and each of the main blades is connected to a corresponding one of the extension blades to form an integral body.

7. The polycrystalline diamond compact drill bit according to claim 6, comprising six main blades and six extension blades arranged uniformly.

8. The polycrystalline diamond compact drill bit according to claim 7, wherein the connecting block is a regular hexagonal prism comprising six outer wall planes consecutively arranged, and the connecting groove is correspondingly provided with six inner wall planes.

9. The polycrystalline diamond compact drill bit according to claim 8, wherein each of the outer wall planes is arranged corresponding to a gap between two adjacent main blades, the inner positioning hole is arranged in a middle portion of the outer wall plane, each of the inner wall planes is arranged corresponding to a gap between two adjacent extension blades, and the outer positioning hole is arranged in the gap between the two adjacent extension blades and penetrates to a middle portion of the inner wall plane.

10. The polycrystalline diamond compact drill bit according to claim 1, wherein the matrix crown is integrally formed by 3D printing.

11. The polycrystalline diamond compact drill bit according to claim 1, wherein a tail end of the positioning member is welded to an outer end port of the outer positioning hole.

12. An oil well drilling apparatus, comprising the polycrystalline diamond compact drill bit according to claim 1.

* * * * *